US005702342A

United States Patent [19]

Metzler et al.

[11] Patent Number: 5,702,342

[45] Date of Patent: Dec. 30, 1997

[54] DIRECTIONALLY-CONTROLLABLE MOUNTING APPARATUS

[75] Inventors: Michael Eugene Metzler, St. Louis; Louis Richard Saller, Imperial, both of Mo.

[73] Assignee: Otologics LLC., St. Louis, Mo.

[21] Appl. No.: 471,891

[22] Filed: Jun. 7, 1995

Related U.S. Application Data

[62] Division of Ser. No. 137,317, Oct. 14, 1993.

[51] Int. Cl.[6] ..... H04R 25/00

[52] U.S. Cl. ..... 600/25

[58] Field of Search ..... 403/220, 225, 403/227; 381/68, 68.1–68.7, 69, 130; 623/10; 600/25; 607/57, 136, 137; 128/898

[56] References Cited

U.S. PATENT DOCUMENTS

| | | | |
|---|---|---|---|
| 1,879,429 | 9/1932 | Noelting et al. . | |
| 2,721,084 | 10/1955 | Weiss . | |
| 3,882,285 | 5/1975 | Nunley et al. . | |
| 4,281,419 | 8/1981 | Treace . | |
| 4,498,461 | 2/1985 | Hakansson . | |
| 4,606,329 | 8/1986 | Hough . | |
| 4,729,366 | 3/1988 | Schaefer . | |
| 4,774,933 | 10/1988 | Hough et al. | 600/25 |
| 4,776,322 | 10/1988 | Hough et al. . | |
| 4,840,178 | 6/1989 | Heide et al. . | |
| 4,904,233 | 2/1990 | Hakansson et al. | 600/25 |
| 4,957,478 | 9/1990 | Maniglia | 600/25 |
| 4,969,900 | 11/1990 | Fleischer | 623/10 |
| 4,988,333 | 1/1991 | Engebretson et al. | 600/25 |
| 5,263,956 | 11/1993 | Nobles | 606/130 |

*Primary Examiner*—Jennifer Bahr
*Assistant Examiner*—Samuel Gilbert
*Attorney, Agent, or Firm*—David A. Warmbold

[57] ABSTRACT

A mounting apparatus for mounting a mounting post in a preselected position. The apparatus includes a primary casing having a side wall and an end wall which define an interior space within the primary casing. A mounting post having a frictional retention member disposed thereon is mounted through the primary casing such that the frictional retention member is disposed within the interior space defined within the primary casing. The mounting apparatus further includes a second end wall constructed to be secured to the primary casing. Securement of the second end wall to the primary casing causes the frictional retention member to be frictionally retained between the first end wall and the second end wall.

22 Claims, 2 Drawing Sheets

DIRECTIONALLY-CONTROLLABLE MOUNTING APPARATUS

This is a divisional of application Ser. No. 08/137,317 filed on Oct. 14, 1993, now abandoned.

BACKGROUND OF THE INVENTION

The present invention relates generally to a mounting apparatus providing directional flexibility, and more particularly to a mounting apparatus for an implantable hearing aid system that provides a significant range of directional orientations to the hearing aid system so as to enable the system to be optimally oriented with respect to the human auditory system.

Implantable hearing aid systems such as those disclosed in U.S. Pat. Nos. 4,988,333 and 5,085,628 to Engebretson, et al. have been shown to provide beneficial results for patients suffering profound hearing loss. Such systems typically are constructed for implantation in the middle ear and provide enhanced transmission of acoustical signals within the auditory system. For example, such systems can be used to transmit vibratory energy between ossicular bones, i.e., the malleus, the incus, and the stapes. In the alternative, such systems can be used to transmit energy directly from the tympanic membrane to the ossicular bones. In either case, hearing aid systems of this type must be directly coupled to a preselected portion of the auditory system and therefore require precise positional and directional placement. Thus, it is desirable to provide a mounting apparatus for hearing aid systems of this type that provides for a significant degree of positional and directional freedom upon implantation of the mounting apparatus and the hearing aid system in the human body.

Prior implantable hearing aid systems typically employed bone plates or screws in order to anchor the hearing aid system to a bone within the skull. However, mounting methods of this type often provided an unsatisfactory orientation of the hearing aid system relative to the human auditory system because the resulting orientation of the hearing aid system was controlled by the contour of the bone surface to which the system was attached, or by the structure of the bone plate itself, rather than being controlled by the optimal orientation between the hearing aid system and the auditory system.

SUMMARY OF THE INVENTION

The mounting apparatus of the present invention includes a primary casing adapted to be secured to the bone. The primary casing includes a side wall defining an interior space within the casing. A first end wall having an aperture therethrough is disposed at one end of the side wall and provides communication between the exterior of the primary casing and the interior space. A mounting post having a frictional retention member mounted thereon is disposed through the interior space and the aperture defined through the first end wall such that the frictional retention member is disposed within the interior space. A second end wall is constructed to be secured to the primary casing. The first end wall and the second end wall are constructed such that the frictional retention member is frictionally retained therebetween at a preselected orientation within the interior space of the primary casing when the second end wall is secured to the primary casing, thereby securing the mounting post in the preselected orientation.

BRIEF DESCRIPTION OF THE DRAWINGS

For a more complete understanding of the present invention, reference may be had to the following Detailed Description read in connection with the accompanying drawings in which.

DETAILED DESCRIPTION

Figure 1:
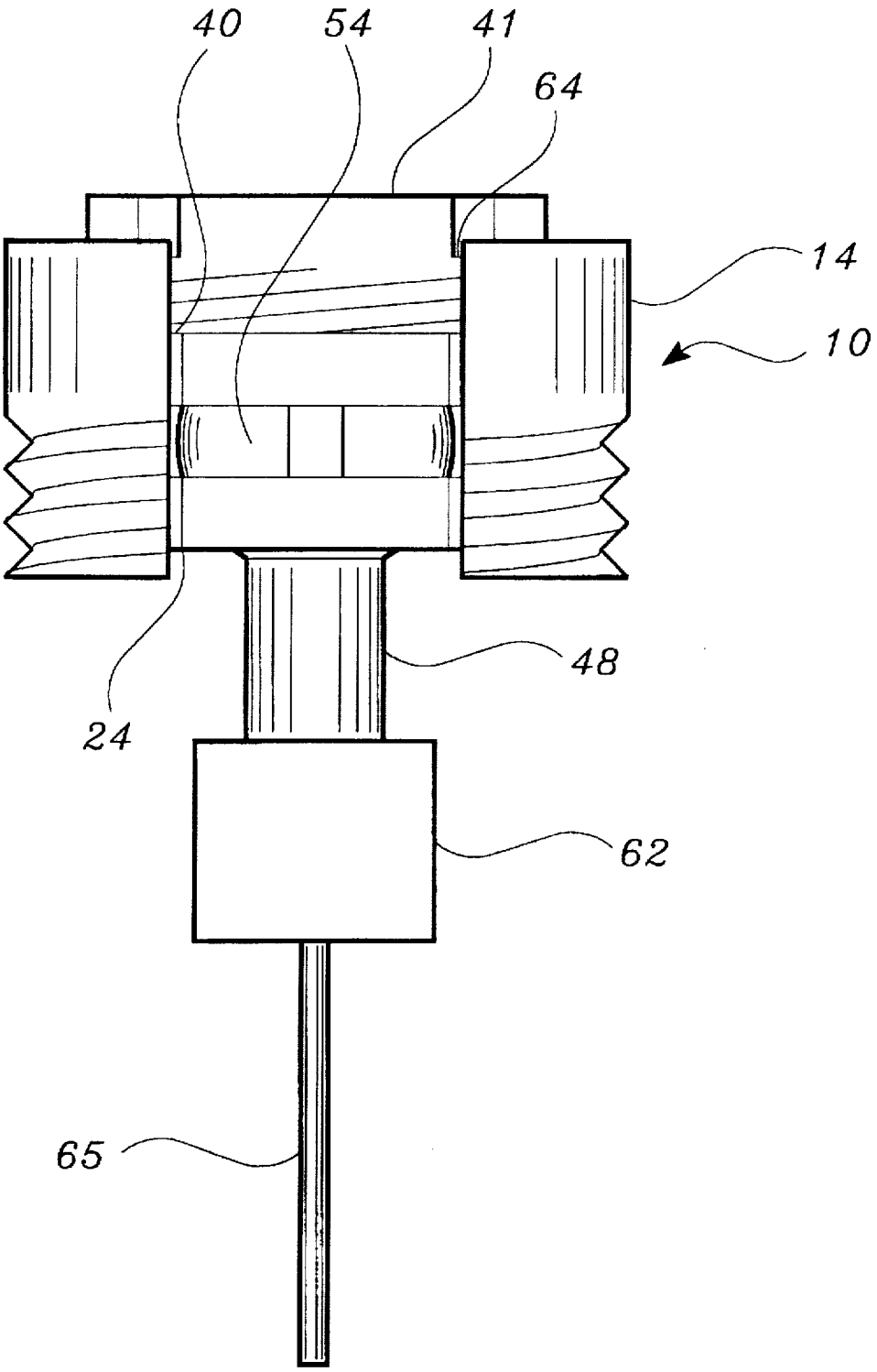
FIG. 1 is a perspective view of a mounting apparatus constructed in accordance with the present invention.
Figure 2:
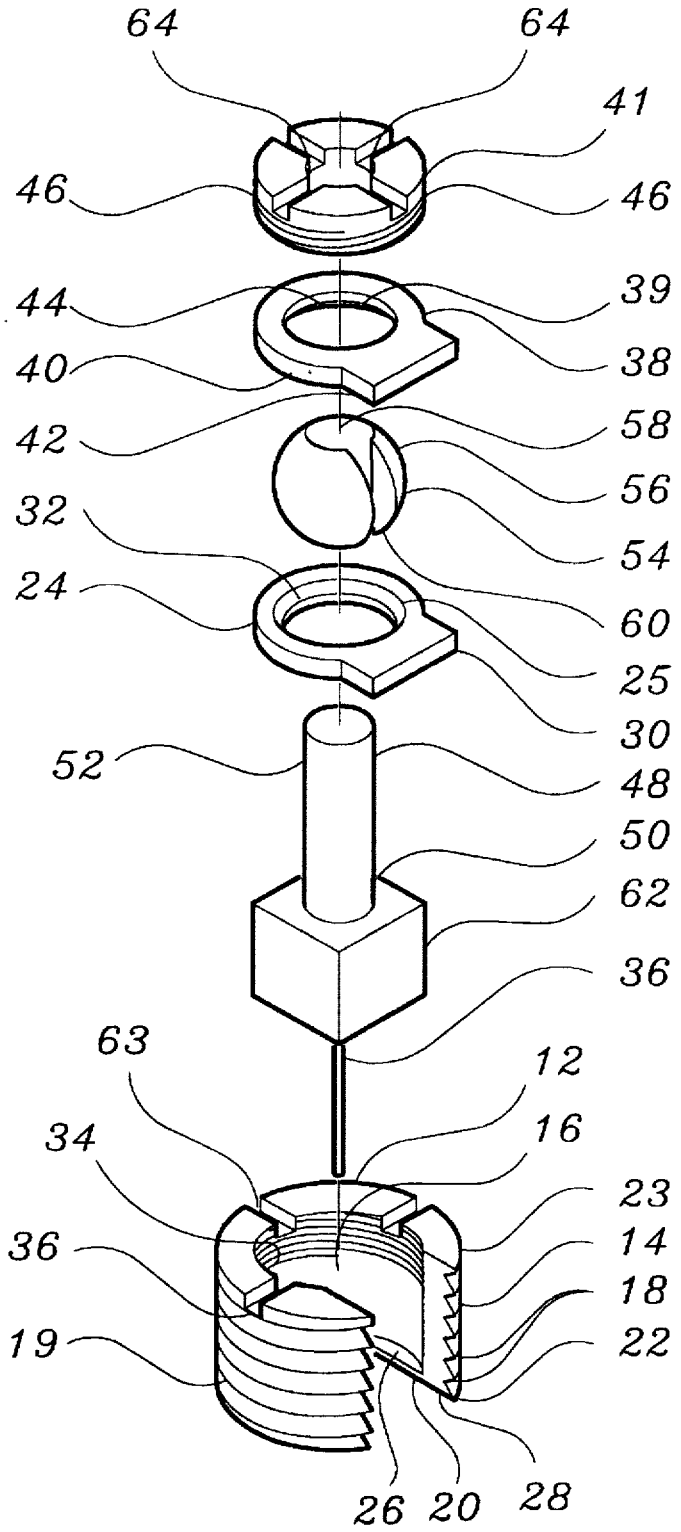
FIG. 2 is an exploded view of a mounting apparatus constructed in accordance with the present invention.

A mounting apparatus constructed in accordance with the present invention is generally indicated at 10 of FIGS. 1 and 2. Mounting apparatus 10 includes primary casing 12 having side wall 14. In the embodiment of the present invention described herein, side wall 14 of primary casing 12 is substantially annular in cross-section, thereby defining an interior space 16 having a substantially circular cross-section within primary casing 12. However, it will be appreciated that side wall 14 and interior space 16 can have a variety of cross-sections without departing from the spirit and scope of the invention.

Primary casing 12 is constructed to be threadably secured to a bone within the skull. In the embodiment of the present invention depicted in FIGS. 1 and 2, external threads 18 are provided on exterior surface 19 of primary casing 12 such that primary casing 12 can be threaded directly into a skull bone, as described in greater detail below. However, it will be appreciated by one of ordinary skill in the art that the mounting apparatus of the present invention can be mounted on a bone through the use of bone plates, bone screws, or other known fixation means.

Primary casing 12 further includes first end wall 20 extending substantially perpendicularly from side wall 14 at first end portion 22 of primary casing 12. First end wall 20 can be formed integrally with side wall 14. However, in the embodiment of the present invention depicted in FIGS. 1 and 2, first end wall 20 is formed by a first washer 24 which is retained by shoulder 26 formed on side wall 14. The external dimension of first washer 24 is preferably substantially identical to the interior dimension of side wall 14 in order to ensure proper positioning of first washer 24 within primary casing 12. For reasons discussed in detail below, first washer 24 preferably includes a beveled shoulder 25.

Primary casing 12 preferably defines a split 28 along its length as depicted in FIG. 2. Split 28 is dimensioned to receive tongue portion 30 of first washer 24, thereby preventing axial rotation of first washer 24 relative to primary casing 12 during use of mounting apparatus 10. Split 28 further facilitates the passing of a hearing aid transducer through primary casing 12, as explained below.

First end wall 20 defines an aperture 32 providing direct communication between interior space 16 of primary casing 12 and the external environment of mounting apparatus 10. In the embodiment of the present invention depicted in FIGS. 1 and 2, aperture 32 is defined by first washer 24. Aperture 32 can have a variety of shapes. However, in the preferred embodiment of the present invention, aperture 32 has a substantially circular shape, thereby providing significant directional flexibility to mounting apparatus 10.

Side wall 14 of primary casing 12 includes an interior surface 34 having internal threads 36 formed thereon. The function and purpose of internal threads 36 is explained in detail below.

Mounting apparatus 10 further includes a second end wall 38 defining a second end wall aperture 39. Second end wall 38 is constructed to be secured to second end portion 23 of primary casing 14. As above-discussed with respect to first end wall aperture 32, second end wall aperture 39 can have any cross-sectional shape, but is depicted herein as having a circular cross-section. In the embodiment of the present invention depicted in FIG. 2, second end wall 38 is formed by second washer 40 and lock ring 41. The external dimension of second washer 40 is preferably substantially identical to the interior dimension of side wall 14 in order to ensure a close fit therebetween. Second washer 40 includes a tongue portion 42 configured to fit closely within split 28 in order to prevent axial rotation of second washer 40 relative to side wall 14. Second washer 40 further includes beveled shoulder portion 44, the purpose and function of which will be explained in detail below.

Lock ring 41 has external threads 46 disposed thereon which are configured to engage internal threads 36 formed on interior surface 34 of side wall 14 such that lock ring 41 can be threaded between an unsecured position on side wall 14 and a secured position on side wall 14. It will be appreciated that lock ring 41 will force second washer 40 towards first washer 24 as lock ring 41 is threadably secured to side wall 14.

Mounting post 48 having a first end portion 50 and a second end portion 52 is configured to be mounted through primary casing 12 as depicted in FIG. 1. Mounting post 48 has a frictional retention member 54 disposed thereon between first end portion 50 and second end portion 52 such that frictional retention member 54 is disposed within primary casing 12. Frictional retention member 54 can have a variety of configurations without departing from the spirit and scope of the present invention. For example, frictional retention member 54 can be integrally formed on mounting post 48. However, by integrally forming frictional retention member 54 on mounting post 48, axial movement of mounting post 48 relative to frictional retention member 54 is precluded. For this reason, the frictional retention member 54 of the embodiment of the present invention depicted in FIGS. 1 and 2 includes a substantially spherical body 56 having a diametrical channel 58 formed therethrough. Diametrical channel 58 is dimensioned to permit mounting post 48 to be slidably mounted through substantially spherical body 56. Substantially spherical body 56 preferably is split to form an elongated aperture 60. In the embodiment of the invention depicted in FIGS. 1 and 2, elongated aperture 60 is substantially parallel to diametrical channel 58. However, it is to be appreciated that elongated aperture 60 can have numerous orientations. The presence of aperture 60 facilitates the frictional retention of mounting post 48 within diametrical channel 58 when substantially spherical body 56 is compressed, as explained in detail below. Substantially spherical body 56, beveled shoulder 25, and beveled shoulder 44 are preferably dimensioned such that substantially spherical body 56 is closely received within beveled shoulder 25 of first washer 24 and beveled shoulder 44 of second washer 40.

As above-discussed, first washer 24 is moved toward second washer 40 when lock ring 41 is threadably tightened to side wall 14. Because substantially spherical body 56 is disposed between first washer 24 and second washer 40, it will become frictionally trapped therebetween upon the tightening of lock ring 41 to side wall 14. Substantially spherical body 56 is preferably constructed of a deformable material such that substantially spherical body 56 deforms as it is compressed between first washer 24 and second washer 40 as lock ring 41 is tightened to side wall 14. It will be appreciated that the resulting deformation of substantially spherical body 56 will facilitate the frictional retention of substantially spherical body 56 between first washer 24 and second washer 40. Such deformation will also cause mounting post 48 to be frictionally retained within diametrical channel 58 of substantially spherical body 56 due to the fact that elongated aperture 60 through substantially spherical body 56 will tend to close when substantially spherical body 56 is compressed between beveled shoulders 25, 44 of first washer 24 and second washer 40.

First end portion 50 of mounting post 48 is constructed to receive an implantable device thereon. In the embodiment of the present invention depicted in FIGS. 1 and 2, first end portion 50 has a transducer 62 of an implantable hearing aid system mounted thereon. However, it is to be appreciated that the mounting apparatus of the present invention can be used with any device that requires precise orientation.

Mounting apparatus 10 is preferably constructed of biocompatible materials. For example, primary casing 12, first washer 24, second washer 40, lock ring 41, and mounting post 48 can be constructed of a biocompatible metal material such as titanium when the present invention is used in conjunction with an implantable hearing aid system. Although frictional retention member 54 also can be constructed of a biocompatible metal material such as titanium, it is preferable that frictional retention member 54 be constructed of a compressible material such as a biocompatible plastic.

Mounting apparatus 10 of the present invention is implanted in the body by forming a channel through a skull bone. When mounting apparatus 10 is used in conjunction with a hearing aid system, the channel preferably is drilled from a point on the exterior of the skull to a point within the middle ear. The dimension of this channel is preferably substantially equal to the outer dimension of primary casing 12 such that primary casing 12 can be threadably secured within the channel. Indentations 63 are formed on primary casing 12 in order to facilitate the threading of primary casing 12 into the bone channel. After primary casing 12 is threadably secured within the channel, mounting post 48 having first washer 24, substantially spherical body 56, and second washer 40 disposed thereon is passed through primary casing 12 such that transducer 62 mounted on first end portion 50 of mounting post 48 extends beyond primary casing 12 and such that lead 65 of transducer 62 extends into the middle ear. Lock ring 41 is then passed over second end portion 52 of mounting post 48 and is partially threadably secured to primary casing 12. Indentations 64 are provided on lock ring 41 in order to facilitate this procedure.

In order to position lead 65 in the desired position relative to the middle ear, it is preferable that a second channel through the skull be formed to provide direct viewing of the middle ear. It will be appreciated that the orientation of mounting post 48 can be varied prior to the complete tightening of lock ring 41 to side wall 14. That is, mounting post 48 can be moved axially to the desired location due to the fact that it is slidably mounted through substantially spherical body 56. Further, second end portion 52 of mounting post 48 can be moved in a joystick fashion in order to effect movement of first end portion 50 and transducer 62. The only limitation on such movement is imposed by the relative dimensions and configurations of apertures 32, 39 defined through first end wall 20 and second end wall 38, respectively.

Lock ring 41 preferably is partially secured to primary casing 14 during the positioning of mounting post 48 and transducer 62 such that substantially spherical body 56 frictionally engages first washer 24 and second washer 40 without causing substantially spherical body 56 to be fixed therebetween. After mounting post 48 and transducer 62 have been positioned in the desired orientation relative to the auditory system, lock ring 41 is threadably tightened to side wall 14 such that substantially spherical body 56 is mechanically deformed between first washer 24 and second washer 40. Due to this deformation of substantially spherical body 56, and due to the presence of elongated aperture 60 therethrough, diametrical channel 58 will tend to collapse on mounting post 48, thereby preventing axial movement of mounting post 48 relative to substantially spherical body 56. Also due to this deformation of substantially spherical body 56, and due to the configurations of beveled shoulders 26, 44 of first washer 24 and second washer 40, respectively, relative to substantially spherical body 56, the positions of mounting post 48 and transducer 62 also become fixed. After securing lock ring 41 to side wall 14 in this manner, second end portion 52 of mounting post 48 can be removed if necessary to facilitate closure of the channel in which mounting apparatus 10 is disposed. In the alternative, second end portion 52 of mounting post 48 can be retained in place in order to facilitate later adjustments to the position of mounting post 48 and transducer 62.

Although the present invention has been described herein with respect to certain preferred embodiments, it will be apparent to one of ordinary skill in the art that various modifications can be made without departing from the spirit and scope of the invention as claimed herein.

What is claimed is:

1. An implantable hearing aid system comprising:

a primary casing having a first end portion and a second end portion, said primary casing comprising a side wall having an interior surface and an exterior surface, said primary casing further comprising a shoulder extending from said interior surface of said side wall at said first end portion of said primary casing, said shoulder having an interior surface, said interior surface of said shoulder and said interior surface of said side wall defining an interior space within said primary casing, said shoulder defining an aperture through said primary casing whereby said interior space is in communication with an external environment of said primary casing;

a first washer disposed within said interior space defined within said primary casing, said first washer having a first surface abutting said interior surface of said shoulder and a second surface opposite said first surface, said first washer defining an aperture therethrough;

a mounting post having a first end portion and a second end portion, said mounting post having a frictional retention member mounted thereon, said first end portion of said mounting post passing through said aperture defined through said first washer and through said aperture defined by said shoulder, said frictional retention member abutting said second surface of said first washer;

a second washer having a first surface and a second surface, said first surface of said second washer abutting said frictional retention member, said second washer being disposed within said interior space defined within said primary casing, said second washer defining an aperture therethrough; and a lock ring secured to said primary casing, said lock ring abutting said second surface of said second washer, whereby said lock ring urges said second washer into abutment with said frictional retention member and urges said frictional retention member into abutment said first washer when said lock ring is secured to said primary casing, and whereby said frictional retention member is frictionally retained between said first washer and said second washer when said lock ring is secured to said primary casing; and a transducer mounted on said first end portion of said mounting post, said transducer being adapted to be coupled to a portion of a human auditory system.

2. An implantable hearing aid system in accordance with claim 1, wherein said exterior surface of said side wall has threads formed thereon, whereby said primary casing is adapted to be threadably secured to a bone.

3. An implantable hearing aid system in accordance with claim 1, wherein said interior surface of said side wall has threads formed thereon, and wherein said lock ring has mating threads formed thereon, whereby said lock ring can be threadably secured to said primary casing, and whereby said lock ring urges said second washer into abutment with said frictional retention member and urges said frictional retention member into abutment with said first washer as said lock ring is threadably secured to said primary casing.

4. A method for implanting a hearing aid system for assisting the transmission of vibratory signals within a middle ear, said method comprising the steps of:

forming a channel through a skull from a point external of said skull to a point within said middle ear;

providing a primary casing having a first end portion and a second end portion, said primary casing comprising a side wall and a first end wall extending from said side wall at said first end portion of said primary casing, said first end wall having an interior surface, said first end wall defining an aperture therethrough, said side wall having an interior surface and an exterior surface, said exterior surface having threads formed thereon, said interior surface of said first end wall and said interior surface of said side wall defining an interior space within said primary casing;

threadably securing said primary casing into said channel whereby said threads formed on said exterior surface of said side wall threadably engage said channel;

providing a mounting post having a first end portion and a second end portion, said mounting post having a frictional retention member mounted thereon, said first end portion of said mounting post having a transducer of an implantable hearing aid system mounted thereon, said transducer having a lead extending therefrom;

placing said mounting post through said primary casing whereby said first end portion of said mounting post extends through said aperture defined through said first end wall, whereby said transducer is external said primary casing, and whereby said frictional retention member abuts said first end wall;

providing a second end wall defining an aperture therethrough, said aperture being configured to permit said second end portion of said mounting post to pass therethrough, said second end wall being constructed to be secured to said primary casing whereby said second end wall and said first end wall frictionally retain said frictional retention member when said second end wall is secured to said primary casing;

passing said second end wall over said second end portion of said mounting post whereby said second end portion of said mounting post extends through said aperture defined through said second end wall;

positioning said first end portion of said mounting post, said transducer, and said lead in a predetermined position using said second end portion of said mounting post; and securing said second end wall to said primary casing whereby said frictional retention member is frictionally retained between said first end wall and said second end wall and whereby said first end portion of said mounting post and said transducer are retained in said predetermined position.

5. A mounting apparatus for use in the middle and inner ear comprising: a primary casing having a first end portion and a second end portion, said primary casing comprising a side wall and a first end wall extending from said side wall at said first end portion of said primary casing, said side wall having an interior surface and an exterior surface opposite said interior surface, said end wall having an interior surface, said interior surface of said side wall and said interior surface of said end wall defining an interior space within said primary casing, said first end wall defining an aperture therethrough such that said interior space is in open communication with an external environment of said primary casing through said aperture;

a mounting post having a first end portion and a second end portion, said mounting post having a frictional retention member mounted thereon, said mounting post being mounted through said interior space of said primary casing and through said aperture defined through said first end wall such that said frictional retention member is disposed within said primary casing and such that said first end portion of said mounting post extends through said aperture defined through said first end wall;

a second end wall secured within said primary casing opposite to said first end wall, said second end wall having an interior surface, whereby said interior surface of said second end wall and said interior surface of said first end wall frictionally retain said frictional retention member and said mounting post in a preselected orientation when said second end wall is secured to said primary casing; and the exterior surface of said side wall having threads formed thereon, whereby said primary casing is adapted to be threadably secured to a bone.

6. A mounting apparatus in accordance with claim 5, wherein said interior surface of said side wall has threads formed thereon, and wherein said second end wall has mating threads formed thereon, whereby said second end wall can be threadably secured to said primary casing, whereby said second end wall moves toward said first end wall as said second end wall is threadably tightened to said primary casing, and whereby said interior surface of said second end wall urges said frictional retention member into engagement with said interior surface of said first end wall as said second end wall is threadably secured to said primary casing.

7. A mounting apparatus in accordance with claim 5, wherein said first end portion of said mounting post is mounted to an implantable hearing aid system adapted for being received within the human ear.

8. A mounting apparatus in accordance with claim 5, wherein said first end wall comprises a shoulder extending from said interior wall of said side wall, said first end wall further comprising a first washer disposed within said interior space of said primary casing in abutment with said shoulder, said first washer defining an aperture therethrough.

9. A mounting apparatus in accordance with claim 8, wherein said first washer has a beveled edge adjacent said aperture defined therethrough, said beveled edge engaging said frictional retention member when said second end wall is secured to said primary casing.

10. A mounting apparatus in accordance with claim 5, wherein said second end wall comprises a washer defining an aperture therethrough, said second end wall further comprising a lock ring defining an aperture therethrough, said lock ring being secured to said primary casing.

11. A mounting apparatus in accordance with claim 10, wherein said washer has a beveled edge adjacent said aperture defined therethrough, said beveled edge engaging said frictional retention member when said second end wall is secured to said primary casing.

12. A mounting apparatus in accordance with claim 10, wherein said side wall defines an aperture providing communication between said interior space and said external environment of said primary casing through said side wall, said washer having a radially extending tongue portion formed thereon, whereby said tongue portion is received within said aperture defined through said side wall and to prevent axial rotation of said washer relative to said side wall.

13. A mounting apparatus in accordance with claim 5, wherein said frictional retention member comprises a substantially spherical body defining a diametrical channel therethrough, said mounting post therethrough; and a lock ring defining an aperture therethrough, said lock ring being secured to said primary casing, said lock ring being abutted to said second end wall, whereby said lock ring urges said second end wall into abutment with said frictional retention member and urges said frictional retention member into abutment with said first end wall when said lock ring is secured to said primary casing, and whereby said frictional retention member is frictionally retained between said first end wall and second end wall when said lock ring is secured to said primary casing.

14. A mounting apparatus in accordance with claim 13, wherein said substantially spherical body is constructed of a deformable material, whereby said substantially spherical body is deformed when said second end wall is secured to said primary casing and whereby said mounting post is retained in said diametrical channel formed through said substantially spherical body when said substantially spherical body is deformed.

15. A mounting apparatus in accordance with claim 13, wherein said substantially spherical body defines an elongated aperture therethrough, said elongated aperture providing direct communication between said external environment of said substantially spherical body and said diametrical channel defined therethrough.

16. A mounting apparatus comprising:

a primary casing having a first end portion and a second end portion, said primary casing comprising a side wall having an interior surface and an exterior surface, said primary casing further comprising a shoulder extending from said interior surface of said side wall at said first end portion of said primary casing, said shoulder having an interior surface, said interior surface of said shoulder and said interior surface of said side wall defining an interior space within said primary casing, said shoulder defining an aperture through said primary casing whereby said interior space is in communication with an external environment of said primary casing;

a first washer disposed within said interior space defined within said primary casing, said first washer having a first surface abutting said interior surface of said shoulder and a second surface opposite said first surface, said first washer defining an aperture therethrough;

a mounting post having a first end portion and a second end portion, said mounting post having a frictional retention member mounted thereon, said first end portion of said mounting post passing through said aperture defined through said first washer and through said aperture defined by said shoulder, said frictional retention member abutting said second surface of said first washer;

a second washer having a first surface and a second surface, said first surface of said second washer abutting said frictional retention member, said second washer being disposed within said interior space defined within said primary casing, said second washer defining an aperture therethrough; and a lock ring defining an aperture therethrough, said lock ring being secured to said primary casing, said lock ring abutting said second surface of said second washer, whereby said lock ring urges said second washer into abutment with said frictional retention member and urges said frictional retention member into abutment with said first washer when said lock ring is secured to said primary casing, and whereby said frictional retention member is frictionally retained between said first washer and second washer when said lock ring is secured to said primary casing.

17. A mounting apparatus in accordance with claim 16, wherein said interior surface of said primary casing has threads formed thereon, and wherein said lock ring has making threads formed thereon, whereby said look ring can be threadably secured to said primary casing and whereby said lock ring urges said second washer into abutment with said frictional retention member and urges said frictional retention member into abutment with said first washer as said lock ring is threadably secured to said primary casing.

18. A mounting apparatus in accordance with claim 16, wherein said frictional retention member comprises a substantially spherical body having a diametrical channel formed therethrough, said mounting post being slidably mounted through said diametrical channel, said substantially spherical body being constructed of a deformable material, whereby said substantially spherical body is deformed when said lock ring is secured to said primary casing and wherein said mounting post is fictionally retained within said diametrical channel when said lock ring is secured to said primary casing.

19. A mounting apparatus in accordance with claim 18, wherein said substantially spherical body defines an elongated aperture therethrough, said elongated aperture providing direct communication between said external environment of said substantially spherical body and said diametrical channel defined therethrough.

20. A mounting apparatus in accordance with claim 16, wherein said side wall defines an aperture providing communication between said interior space and said external environment of said primary casing through said side wall, said first washer having a first tongue portion extending therefrom, said second washer having a second tongue portion extending therefrom, said first tongue portion and said second tongue portion fitting within said aperture defined through said side wall, whereby said first tongue portion and said second tongue portion prevent axial rotation of said first washer and said second washer relative to said primary casing.

21. A mounting apparatus in accordance with claim 16, wherein said exterior surface of said side wall has threads formed thereon, whereby said primary casing is adapted to be threadably secured to a bone.

22. A mounting apparatus in accordance with claim 16, wherein said second surface of said first washer is beveled adjacent said aperture defined therethrough, and wherein said first surface of said second washer is beveled adjacent said aperture defined therethrough.

* * * * *